United States Patent [19]

Liska

[11] 4,332,532

[45] Jun. 1, 1982

[54] PISTON PUMP, ESPECIALLY RADIAL PISTON PUMP

[75] Inventor: Georg Liska, Zimmerbach, Fed. Rep. of Germany

[73] Assignee: Zahnradfabrik Friedrichshafen, AG, Friedrichshafen, Fed. Rep. of Germany

[21] Appl. No.: 89,482

[22] Filed: Oct. 30, 1979

[30] Foreign Application Priority Data

Nov. 10, 1978 [DE] Fed. Rep. of Germany ..... 2848841

[51] Int. Cl.[3] ..... F04B 1/18

[52] U.S. Cl. ..... 417/273; 417/313

[58] Field of Search ..... 417/273, 271, 372, 269, 417/523, 521, 313

[56] References Cited

U.S. PATENT DOCUMENTS

| | | | |
|---|---|---|---|
| 603,805 | 5/1898 | Wood | 417/523 |
| 1,320,792 | 11/1919 | Noguera | 417/273 |
| 2,472,355 | 6/1949 | Whittingham | 417/273 |
| 2,679,808 | 6/1954 | Thun | 417/273 |
| 3,021,995 | 2/1962 | Neubauer | 417/273 |
| 3,191,544 | 6/1965 | Szekely | 417/273 |
| 3,712,759 | 1/1973 | Olson | 417/269 |
| 3,785,751 | 1/1974 | Nemoto | 417/269 |
| 3,981,629 | 9/1976 | Nakayama | 417/269 |

FOREIGN PATENT DOCUMENTS

| | | | |
|---|---|---|---|
| 2323269 | 11/1974 | Fed. Rep. of Germany | 417/271 |
| 2270460 | 5/1975 | France | 417/312 |

*Primary Examiner*—William L. Freeh

*Attorney, Agent, or Firm*—Zalkind & Shuster

[57] ABSTRACT

A plural piston pump is provided wherein the pistons are carried in bores in a body or hub on a radial plane surrounding an actuating cam and wherein a common pulsator chamber is provided comprised of axial recesses in the hub intermediate the pistons communicates with an annular channel in the hub. The arrangement provides a compact form of pump consisting essentially of a hub member externally sealed in a cylindrical housing open at its ends. The hub is provided with inlet and outlet ports, thus eliminating the need for housing ports and housing end pieces or closures and a relatively large pressure or pulsator chamber volume is formed for smoothing out pump pulsations.

4 Claims, 2 Drawing Figures

PISTON PUMP, ESPECIALLY RADIAL PISTON PUMP

Figure 1:
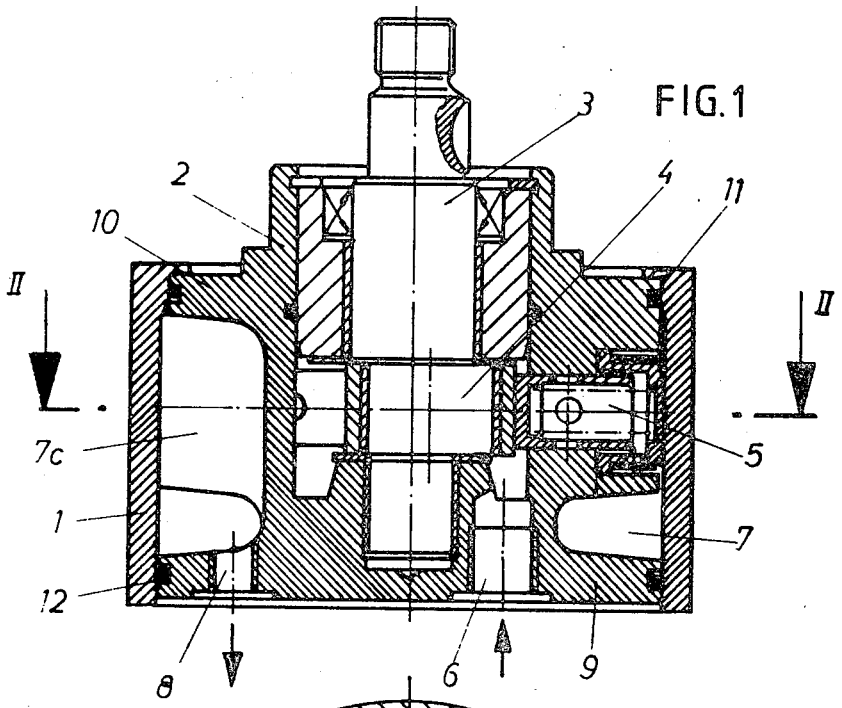

The general construction of prior art pumps provides pressure or pulsator chambers for the purpose of smoothing out pressure pulsations which occur in the operation of reciprocal pistons. Such pulsator chambers have their effect in smoothing out pulsations, as is well known, by elasticity of the pressure medium being pumped as well as the elasticity of the wall surrounding the pulsator chamber. It is known that increased pulsator chamber effect can be achieved by increasing the volume of the chamber. Accordingly, in prior art arrangements the housing of the pump was made axially longer in order to create a larger pulsator chamber. However, such expedient has a certain drawback in that the manufacture is more complex and more expensive and the pump produced is increased in size with undesirable increase in weight as well as causing possible problems where a pump has to be installed in a cramped space.

The invention disclosed herein overcomes the drawbacks of the prior art in a simple and economical manner and produces a multipiston pump by the expedient of providing a pump body or hub radially bored to accommodate reciprocal pistons and wherein such pump body or hub has longitudinal recesses formed in it of considerable volume. All such recesses are in communication with an annular pulsator chamber so as to form compositely a large pulsator chamber to take the discharge from a plurality of piston pumps operated successively by cam actuation. Thus, the entire pulsator chamber volume is formed in the hub, with the cylindrical housing not being specially formed or enlarged for such purpose.

Accordingly, the construction just generally described eliminates an enlarged housing heretofore used for a pulsator chamber located above the pump body which carries the pistons. Further, by providing a housing which is a relatively simple cylinder around the hub a very simple construction, low cost in manufacture is achieved and the weight of a pump for effecting the same capacity of discharge and smoothing effect is less than that of prior art constructions. Thus, the recesses in the pump body or piston carrying hub result in weight reduction by the elimination of solid metal.

Simplicity of design of the invention is brought about by closing off the radial recesses as well as the annular channel of the piston carrying hub by the simple surrounding cylinder which forms the housing and this also results in a manufacturing advantage in that the inlet and outlet ports can be effected directly in the hub with no connections to the exterior housing.

A still further advantage resides in the present invention in that the hub itself has its radial end faces exposed and thus forms the end walls of the assembly, wherein conventional sealing rings intermediate the hub and the surrounding cylindrical jacket may be used in assembly.

Accordingly, end plates or caps for a housing are rendered unnecessary, and a reduction in parts and consequent cost saving in manufacture is achieved. Thus, the essential parts of the invention comprise aside from the cam and the moving parts such as the pistons, a piston carrying body or hub which may be of gray cast iron or aluminum in which the recesses are formed in the casting process and no essential machining is required, along with a surrounding cylindrical housing of any suitable compatible metal or material which can be press fitted around the hub or otherwise secured.

It has been found that with constructions utilizing the invention described herein as compared with conventional multipump piston construction for the same number of pistons, the pulsation smoothing effect is markedly improved. In instances of multipiston pumps of the construction disclosed herein, with a lesser number of cylinders, the pressure of pulsations is higher but the spacing between the piston cylinder bore portions of the hub are greater, so that more volume is available for the recesses which form the pulsator chamber. This is of special significance for multipiston pumps with a reduced number of cylinders, which, of course, are less expensive than pumps having a larger number of cylinders and which accordingly can be manufactured without experiencing substantially higher pressure pulsations.

Figure 2:
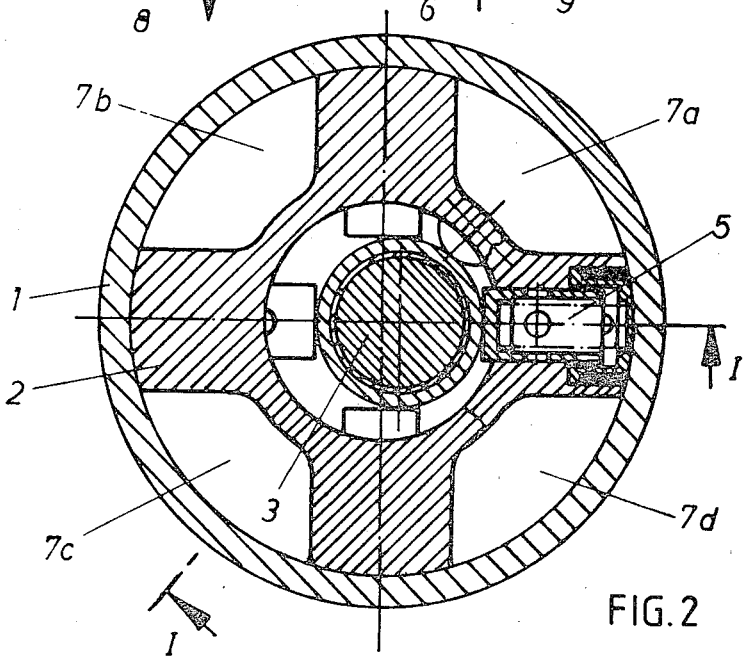

A detailed description of the invention now follows in conjunction with the appended drawing in which:

FIG. 1 is a longitudinal section on the line I—I of FIG. 2 through a multipiston pump incorporating features of the invention, and FIG. 2 is a radial section on the line II—II of FIG. 1.

Referring to the drawing, a cylindrical housing 1 encompasses a pump body in the form of a hub 2 which carries an array of angularly spaced radial pump bores in a common plane with respective pistons and pump elements therein, of generally conventional construction and operation.

Hub 2 has a drive shaft 3 having a cam 4 which actuates the pistons 5 of a four-pump arrangement. Inlet feed, for example, oil, is via port 6 provided directly in hub 2 and oil therefrom reaches the individual pumps via a manifold 6*a*. The discharge of each pump connects to a pressure or pulsator chamber 7, an annular channel recessed into the hub to provide chamber volume. The channel 7 communicates with the outlet port 8 which is provided directly in hub 2.

Conventional ported valving in the individual pumps is provided.

It will be noted at this time that although the individual pump mechanisms and operation have heretofore been known, the arrangement of the inlet 6 and outlet 8 connections are directly in the pump hub 2 rather than to a pump housing, and it will also be noted that the chamber 7 is closed off exteriorly by the cylindrical housing 1, although its volume is afforded by a hollowing of the material of hub 2 instead of by an enlarged housing space, two features distinguishing from known constructions.

A novel feature of the invention resides in the further hollowing, recessing, or channeling, of the exterior of hub 2 for provision of additional pressure or pulsator chambers 7*a*, 7*b*, 7*c* and 7*d* in the hub midsection. Such additional chambers extend axially of the hub and communicate with the common chamber 7, thus increasing compositely the total volume of pulsator chamber space. Channel 7 is closed at its bottom by an end wall 9 of the hub. The other end of the hub is closed by an end wall 10. These end walls are all integral with the hub 2 and the entire hub and end walls together with the hollowing of recesses 7*a*–7*b* and channel 7 are thus made in a single casting.

The end walls 9 and 10 are provided with peripheral sealing rings 11 and 12, respectively, so that housing 1 when placed in position around hub 2 as by a friction fit or shrink fit, or in any suitable manner of known assembly, effects a complete and compact multipiston pump.

From the above, it will be apparent that for any number of pump bores a chambered hub can be utilized by hollowing out a hub between pairs of pump bores. All such recesses add their cumulative volumes to the volume of communicating chamber 7 likewise hollowed out so that, compositely, the effect is to produce a large pulsator chamber to smooth out pulsations in the multipulsing action of the pump as the pistons successively discharge.

As a matter of choice and need, any suitable number of pump chambers in equiangular radially extending array may be provided. As a matter of inherency of the construction, where fewer pistons are used, the hollowed spaces between pump bores are larger and therefore the pulsator chamber effect is increased. This is a decided advantage for smaller and cheaper pumps with few pistons which ordinarily would have a decrease in smoothness of ultimate discharge since the pressure pulsations are spaced further apart in point of time and therefore have a more pronounced pulsating effect. Accordingly, the invention has effective pulse smoothing in multipiston pumps having very few pistons. Moreover, still as a matter of inherency, the novel construction is very compact since by chamber means at the hub exterior provided in any suitable manner an enlarged housing chamber is eliminated.

It will be recognized that the principle of providing chambering means for the hub can be carried out with changes in method. For example, the outer periphery of the hub 2 could be provided with a closed skirt chambered with axially aligned bores or perforations.

Accordingly, the invention is not limited to the precise illustration except as set forth in the appended claims.

What is claimed is:

1. In a multipiston pump having a hub encompassed by a housing and said hub having a plurality of angularly spaced pumps spaced around a central axis thereof; the improvement which comprises;

said hub having a common pulsator chamber extending therearound connecting directly to said pumps and being recessed from the hub exterior into said hub;

said hub having additional pulsator chamber volumes recessed therein from the exterior thereof intermediate said pumps and merging with said common pulsator chamber to effect an increase in pulsator chamber volume;

said housing encompassing said hub and peripherally closing said common pulsator chamber and said additional pulsator chamber volumes;

said hub having an inlet communicating with said pumps and an outlet communicating with said common pulsator chamber; said common pulsator chamber communicating with said additional pulsator chamber volumes and being located between said outlet and said pulsator chambers.

2. In a multipiston pump as set forth in claim 1, said hub having spaced end walls extending radially thereof and effecting closure walls for said common pulsator chamber and said additional pulsator chambers;

said end walls having peripherally sealed engagement with said housing.

3. In a multipiston pump as set forth in claim 1, said inlet and outlet comprising ports in one of said end walls.

4. In a multipiston pump as set forth in claim 1, said hub having spaced end walls extending radially thereof and effecting closure walls for said common pulsator chamber and said additional pulsator chambers;

said end walls having peripherally sealed engagement with said housing;

said inlet and outlet comprising ports in one of said end walls.

* * * * *